US008214928B1

(12) United States Patent
Cleveland et al.

(10) Patent No.: US 8,214,928 B1
(45) Date of Patent: Jul. 10, 2012

(54) HEADGUARD WITH AN ECCENTRIC DIMPLE FOR ACCOMMODATING THE OCCIPITAL BONE

(75) Inventors: William K. Cleveland, El Cajon, CA (US); Russ Boelhauf, Coronado, CA (US)

(73) Assignee: FULL90 Sports, Inc., San Diego, CA (US)

( * ) Notice: Subject to any disclaimer, the term of this patent is extended or adjusted under 35 U.S.C. 154(b) by 260 days.

(21) Appl. No.: 12/260,248

(22) Filed: Oct. 29, 2008

(51) Int. Cl.

| | |
|---|---|
| ***A42B 1/22*** | (2006.01) |
| ***A42B 1/06*** | (2006.01) |
| ***A42B 3/00*** | (2006.01) |
| ***A63B 71/10*** | (2006.01) |

(52) U.S. Cl. ..... 2/417; 2/410; 2/411; 2/414; 2/418; 2/425; 2/DIG. 11

(58) Field of Classification Search ..... 2/410, 6.6, 2/416, 417, 418, 421, 422, 424, 425, 9, 171, 2/171.2, 171.4, 171.5, 171.7, 171.8, 181, 2/181.2, 181.4, 181.6, 181.8, 182.3, 183, 2/209.13, 209.14, 209.3, 209.4, 175.1, 175.2, 2/175.3, 175.4, 175.5, 175.6, 175.7, 175.8, 2/175.9, 195.1, 195.2, 195.3, 195.4, 195.5, 2/195.6, 195.7, 195.8, 918, DIG. 11; D2/865, D2/866, 877, 881, 884, 894
See application file for complete search history.

(56) References Cited

U.S. PATENT DOCUMENTS

| | | | | |
|---|---|---|---|---|
| 532,567 | A | 1/1895 | Larwood, Jr. | |
| 1,004,737 | A * | 10/1911 | Brewster | 2/463 |
| 1,023,285 | A * | 4/1912 | White | 2/9 |
| 1,209,093 | A | 12/1916 | Whitlow | |
| 1,237,048 | A | 8/1917 | Idoux | |
| 1,434,607 | A * | 11/1922 | Gilson | 132/274 |
| 1,463,810 | A | 8/1923 | Gilson | |
| 1,537,178 | A | 5/1925 | Maynard | |
| 1,638,756 | A | 8/1927 | Wallman | |
| 1,652,288 | A | 12/1927 | Mullins | |
| 2,391,335 | A | 12/1945 | O'Brien | |

(Continued)

FOREIGN PATENT DOCUMENTS

| | | |
|---|---|---|
| CA | 2316964 | 6/1999 |

(Continued)

OTHER PUBLICATIONS

Seven Photographs of "Gilbert Rugby" Protective Headgear.

(Continued)

*Primary Examiner* — Khoa Huynh
*Assistant Examiner* — Jane Yoon
(74) *Attorney, Agent, or Firm* — Sherrill Law Offices, PLLC

(57) ABSTRACT

The present claimed invention is directed to a protective headguard, comprising a rear pad to protectively cover at least the occipital lobe on the back of a human head. The rear pad has an eccentric dimple for accommodating the occipital lobe. A front pad is configured and arranged to protectively cover at least the forehead of a human. The front pad is releasably interconnected to the rear pad at separate and distinct upper and lower connection points on the rear pad positioned on opposite sides of the dimple. The fit of the headguard can be adjusted between a first and second configuration by disconnecting the front and rear pads, rotating the rear pad 180° and reconnecting the front and rear pads with the front pad connections to the rear pad exchanged as between the upper and lower connection points.

2 Claims, 3 Drawing Sheets

U.S. PATENT DOCUMENTS

| | | | | |
|---|---|---|---|---|
| 2,607,036 | A | 8/1952 | McCoy | |
| 2,768,380 | A | 10/1956 | Golomb | |
| 2,969,547 | A | 1/1961 | Dye | |
| 3,082,428 | A * | 3/1963 | Zbikowski | 2/418 |
| 3,087,166 | A | 4/1963 | Howard | |
| 3,116,488 | A * | 1/1964 | Zbikowski | 2/418 |
| 3,159,160 | A | 12/1964 | Ullom | |
| 3,171,133 | A | 3/1965 | Steffen | |
| 3,248,738 | A | 5/1966 | Morgan | |
| 3,629,864 | A | 12/1971 | Latina | |
| 3,725,956 | A | 4/1973 | Reisen | |
| 3,784,984 | A | 1/1974 | Aileo | |
| 3,843,970 | A | 10/1974 | Marietta et al. | |
| 3,882,547 | A | 5/1975 | Morgan | |
| 3,946,441 | A | 3/1976 | Johnson | |
| 3,992,721 | A | 11/1976 | Morton | |
| 4,023,209 | A | 5/1977 | Frieder et al. | |
| 4,044,400 | A | 8/1977 | Lewicki et al. | |
| 4,058,854 | A | 11/1977 | Rhee | |
| 4,062,067 | A | 12/1977 | Franzen | |
| 4,068,323 | A | 1/1978 | Gwon | |
| 4,075,717 | A | 2/1978 | Lemelson | |
| 4,204,543 | A | 5/1980 | Henderson | |
| 4,222,122 | A | 9/1980 | Toms | |
| 4,239,106 | A | 12/1980 | Alieo | |
| 4,279,037 | A | 7/1981 | Morgan | |
| 4,290,149 | A | 9/1981 | Alieo | |
| 4,317,239 | A | 3/1982 | Bryksa | |
| 4,345,336 | A | 8/1982 | Plastino | |
| 4,354,284 | A | 10/1982 | Gooding | |
| 4,398,306 | A | 8/1983 | Gooding | |
| 4,404,690 | A | 9/1983 | Farquharson | |
| 4,443,891 | A | 4/1984 | Blomgren et al. | |
| 4,481,681 | A | 11/1984 | Hankin | |
| 4,484,364 | A | 11/1984 | Mitchell et al. | |
| 4,539,715 | A | 9/1985 | Clement | |
| 4,558,470 | A | 12/1985 | Mitchell et al. | |
| 4,581,773 | A | 4/1986 | Cunnane | |
| 4,612,672 | A | 9/1986 | Schrack | |
| 4,613,993 | A | 9/1986 | Steele et al. | |
| 4,646,367 | A | 3/1987 | El Hassen | |
| 4,698,852 | A | 10/1987 | Romero | |
| 4,706,305 | A | 11/1987 | Cho | |
| 4,710,985 | A | 12/1987 | Dubner et al. | |
| 4,741,054 | A | 5/1988 | Mattes | |
| 4,766,610 | A | 8/1988 | Mattes | |
| 4,766,614 | A | 8/1988 | Cantwell et al. | |
| 4,768,231 | A | 9/1988 | Schrack | |
| 4,790,035 | A | 12/1988 | Whyte | |
| 4,827,537 | A | 5/1989 | Villa | |
| 4,843,642 | A | 7/1989 | Brower | |
| 4,847,921 | A | 7/1989 | Leutholt et al. | |
| 4,854,319 | A | 8/1989 | Tobin | |
| 4,864,662 | A | 9/1989 | Frank | |
| 4,910,804 | A | 3/1990 | Lidgren | |
| 4,916,759 | A | 4/1990 | Arai | |
| 4,947,488 | A | 8/1990 | Ashinoff | |
| 4,982,451 | A | 1/1991 | Graham | |
| 4,988,291 | A * | 1/1991 | Grummons | 433/5 |
| 5,012,533 | A | 5/1991 | Raffler | |
| 5,014,365 | A * | 5/1991 | Schulz | 2/412 |
| 5,035,009 | A | 7/1991 | Wingo et al. | |
| 5,042,093 | A | 8/1991 | Legendre | |
| 5,044,016 | A | 9/1991 | Coombs | |
| 5,075,903 | A | 12/1991 | Richoux | |
| 5,081,717 | A | 1/1992 | Shedd et al. | |
| 5,083,321 | A | 1/1992 | Davidson | |
| 5,094,229 | A * | 3/1992 | Pomatto et al. | 602/17 |
| 5,136,657 | A | 8/1992 | Hattori | |
| 5,173,970 | A | 12/1992 | Shifrin | |
| 5,177,815 | A | 1/1993 | Andujar | |
| 5,184,354 | A | 2/1993 | Alfaro et al. | |
| 5,197,292 | A | 3/1993 | McPherson | |
| D339,677 | S | 9/1993 | Kang | |
| 5,271,103 | A | 12/1993 | Darnell | |
| D343,927 | S | 2/1994 | Hamdan | |
| 5,315,718 | A | 5/1994 | Barson et al. | |
| 5,321,854 | A * | 6/1994 | Kronenberger | 2/209.7 |
| 5,337,420 | A | 8/1994 | Haysom et al. | |
| 5,341,516 | A | 8/1994 | Keim | |
| 5,361,420 | A | 11/1994 | Dobbs et al. | |
| 5,392,468 | A | 2/1995 | Leddick, III | |
| 5,437,064 | A | 8/1995 | Hamaguchi | |
| 5,450,631 | A | 9/1995 | Egger | |
| 5,504,945 | A | 4/1996 | Purnell | |
| 5,511,250 | A | 4/1996 | Field et al. | |
| D370,309 | S | 5/1996 | Stucky | |
| 5,515,546 | A | 5/1996 | Shifrin | |
| 5,519,895 | A | 5/1996 | Barnes, Jr. | |
| 5,535,454 | A | 7/1996 | Ryan | |
| 5,539,934 | A | 7/1996 | Ponder | |
| 5,544,367 | A | 8/1996 | March, II | |
| 5,551,094 | A | 9/1996 | Navone | |
| 5,557,807 | A | 9/1996 | Hujar et al. | |
| 5,572,749 | A * | 11/1996 | Ogden | 2/421 |
| 5,581,818 | A | 12/1996 | Lorenzi et al. | |
| 5,615,419 | A | 4/1997 | Williams | |
| 5,628,071 | A | 5/1997 | Nezer | |
| 5,638,551 | A | 6/1997 | Lallemand | |
| 5,640,721 | A | 6/1997 | Jackson | |
| 5,659,900 | A | 8/1997 | Arney et al. | |
| 5,661,854 | A | 9/1997 | March, II | |
| 5,666,670 | A * | 9/1997 | Ryan et al. | 2/425 |
| 5,680,656 | A | 10/1997 | Gath | |
| 5,687,426 | A | 11/1997 | Sperber | |
| 5,701,609 | A | 12/1997 | Bridges | |
| 5,701,610 | A | 12/1997 | Hsu | |
| 5,704,072 | A | 1/1998 | Garneau | |
| 5,774,901 | A | 7/1998 | Minami | |
| 5,790,988 | A | 8/1998 | Guadagnino, Jr. et al. | |
| 5,794,270 | A | 8/1998 | Howat | |
| 5,826,277 | A | 10/1998 | McConville | |
| 5,862,528 | A | 1/1999 | Saijo et al. | |
| 5,875,494 | A * | 3/1999 | Garnier et al. | 2/209.7 |
| 5,882,205 | A | 3/1999 | Peterson | |
| D410,768 | S | 6/1999 | Hirsh | |
| 5,926,849 | A | 7/1999 | Boyle | |
| 5,930,841 | A | 8/1999 | Lampe et al. | |
| 5,933,872 | A * | 8/1999 | Lema | 2/209.7 |
| 5,943,706 | A | 8/1999 | Miyajima et al. | |
| 5,946,734 | A | 9/1999 | Vogan | |
| 5,956,777 | A | 9/1999 | Popovich | |
| 5,963,989 | A | 10/1999 | Robertson | |
| 6,000,062 | A | 12/1999 | Trakh | |
| 6,000,944 | A | 12/1999 | Schiefer | |
| D423,725 | S | 4/2000 | Krutouz | |
| 6,058,515 | A | 5/2000 | Kitahara | |
| 6,065,159 | A | 5/2000 | Hirsh | |
| 6,088,840 | A | 7/2000 | Im | |
| 6,266,827 | B1 | 7/2001 | Lampe et al. | |
| 6,289,522 | B1 * | 9/2001 | Jones et al. | 2/425 |
| 6,339,849 | B1 | 1/2002 | Nelson et al. | |
| 6,349,416 | B1 | 2/2002 | Lampe et al. | |
| 6,367,090 | B1 | 4/2002 | Im | |
| 6,381,760 | B1 | 5/2002 | Lampe et al. | |
| 6,385,780 | B1 | 5/2002 | Racine | |
| 6,389,607 | B1 | 5/2002 | Wood | |
| 6,397,399 | B1 | 6/2002 | Lampe et al. | |
| 6,421,840 | B1 | 7/2002 | Chen et al. | |
| 6,423,019 | B1 * | 7/2002 | Papay et al. | 602/17 |
| 6,428,494 | B1 * | 8/2002 | Schwenn et al. | 602/17 |
| 6,438,761 | B1 | 8/2002 | McGarrita | |
| 6,467,099 | B2 | 10/2002 | Dennis et al. | |
| 6,490,730 | B1 | 12/2002 | Lyden | |
| 6,560,787 | B2 | 5/2003 | Mendoza | |
| 6,571,799 | B1 * | 6/2003 | Daly | 128/857 |
| 6,584,983 | B1 * | 7/2003 | Nicot et al. | 132/53 |
| 6,592,536 | B1 * | 7/2003 | Argenta | 602/17 |
| 6,625,820 | B1 | 9/2003 | Lampe et al. | |
| 6,658,671 | B1 | 12/2003 | Von Holst et al. | |
| 6,675,395 | B1 | 1/2004 | Abraham | |
| 6,751,808 | B2 | 6/2004 | Puchalski | |
| 6,773,449 | B2 * | 8/2004 | Wexler | 606/204.15 |
| 6,883,181 | B2 | 4/2005 | Long | |
| 6,925,657 | B2 | 8/2005 | Takahashi et al. | |
| 6,978,478 | B2 | 12/2005 | Urakawa | |
| 7,153,284 | B2 * | 12/2006 | Argenta | 602/17 |

| | | | | |
|---|---|---|---|---|
| 2001/0032351 | A1 | 10/2001 | Nakayama et al. | |
| 2001/0047537 | A1 | 12/2001 | Robertson | |
| 2002/0004494 | A1 | 1/2002 | Bachienga | |
| 2002/0017805 | A1 | 2/2002 | Carroll, III et al. | |
| 2002/0023291 | A1 | 2/2002 | Mendoza | |
| 2002/0069452 | A1 | 6/2002 | Knappl | |
| 2002/0083512 | A1 | 7/2002 | Tsujino | |
| 2002/0152542 | A1 | 10/2002 | Dennis et al. | |
| 2002/0189004 | A1 | 12/2002 | Aaron | |
| 2004/0117896 | A1 | 6/2004 | Madey et al. | |
| 2004/0168246 | A1 | 9/2004 | Phillips | |
| 2004/0250340 | A1 | 12/2004 | Piper et al. | |
| 2005/0044611 | A1 | 3/2005 | Abraham | |
| 2005/0166302 | A1 | 8/2005 | Dennis | |
| 2005/0251898 | A1* | 11/2005 | Domingos | 2/412 |
| 2006/0059605 | A1 | 3/2006 | Ferrara | |
| 2006/0064798 | A1 | 3/2006 | Abraham | |
| 2006/0101559 | A1 | 5/2006 | Moore et al. | |
| 2006/0162054 | A1 | 7/2006 | Lardeau | |
| 2006/0260026 | A1 | 11/2006 | Doria et al. | |
| 2007/0000032 | A1 | 1/2007 | Morgan | |
| 2007/0245451 | A1 | 10/2007 | Desjardins et al. | |
| 2008/0172779 | A1 | 7/2008 | Ferguson | |
| 2008/0184457 | A1 | 8/2008 | Pham | |
| 2008/0201825 | A1* | 8/2008 | Chun | 2/209.13 |
| 2009/0255030 | A1* | 10/2009 | Guy | 2/84 |
| 2010/0162472 | A1* | 7/2010 | Abraham | 2/411 |

FOREIGN PATENT DOCUMENTS

| | | |
|---|---|---|
| DE | 10003125 | 8/2001 |
| EP | 393238 | 10/1990 |
| FR | 2390616 | 5/1997 |
| GB | 2202729 | 10/1988 |
| GB | 2333690 | 8/1999 |
| GB | 2348110 | 7/2002 |
| WO | 8804188 | 6/1988 |
| WO | 9614768 | 5/1996 |
| WO | 9929199 | 6/1999 |
| WO | 0145526 | 6/2001 |

OTHER PUBLICATIONS

Seven Photographs of "CCC" Protective Headgear.

"Can sports-Minded Kids Have Too Many Helmets?" Thomas B. Cole, JAMA, vol. 275, No. 8, May 18, 1996.

"Head and Neck Injuries in Soccer" Alf Thorvald Tysvaer, 1992.

* cited by examiner

HEADGUARD WITH AN ECCENTRIC DIMPLE FOR ACCOMMODATING THE OCCIPITAL BONE

BACKGROUND

The prior art contains many examples of protective headguard systems. The prior art describes a variety of fit and retention systems.

Headguard fit and retention systems are intended to keep the headgear on the head during use, maintain fit and comfort while in use, and allow the user to easily put on and take off the headgear when desired.

Fit and retention systems must deal with the basic characteristics of the human head: the generally spheroidal shape; the neck; and the various features such as the face, ears, frontal bone, occipital bone, or the parietal eminences.

Protective helmets use various means to improve retention and fit. For those with hard and stiff shells, compressible padding, padding inserts, and adjustable suspension are some of the means by which different head sizes can be accommodated. Football, hockey, bicycle helmets, and construction hard hats would fall into this category. For headgear with soft flexible shells, such as the headgear used in boxing, the martial arts, or soccer, the shape of the entire piece of headgear can be altered with, for example, adjustment straps to help conform it to the shape of the head.

In many instances, however, additional retention means such as chinstraps become necessary. Chinstraps typically attach near the edges of the helmet close to the ears and either pass under the chin or over the chin. A fastening system such as a buckle or snap allows the user to fasten and unfasten the chinstrap.

While chinstraps may help retain a helmet on the head, chinstraps can pose problems. First, chinstraps may heighten risk by increasing the rigidity of the head protection system. Forces applied to the head at angular vectors may cause the helmet and the head to rotate. Significant rotational forces can harm both the brain and the neck. An inflexible chinstrap therefore may contribute to injury by placing additional strain on the head as it rotates.

Second, chinstraps often require difficult and inconvenient adjustments for proper fit. In many instances such adjustments may be difficult and inconvenient. Third, chinstraps are often uncomfortable. Chinstraps that run over the chin usually require a cup to fit on the chin. A chin-cup may restrict the jaw and limit activities such as speech. Finally, even properly adjusted chinstraps may do little to prevent minor shifts in the helmet during normal use. These minor shifts can be very bothersome for activities, for example, that require unimpeded sight.

Various means have been attempted to improve fit and retention to overcome the shortcomings of systems that rely primarily on the chinstrap. Doing so often requires balancing fit, retention, and comfort. With almost any headgear, retention can be improved by simply making the headgear fit tighter. For headgear such as knit winter hats or winter headbands this does not typically pose a problem. A knit winter hat can fit relatively tight without causing discomfort. The lightness, elasticity, and conformability of such headgear are likely reasons for this.

For many kinds of protective headgear, however, creating a tighter fit merely results in discomfort. An American football helmet with a tight fit can be very uncomfortable. The bulk, inelasticity of the headgear structure, and the pressure points created where padding is compressed to fit variations on the head's surface could be causes for this.

Alternatives to simply tightening the fit have been developed. Many bicycle helmets, for example, have devices that cradle the occipital bone. These systems are not intended to eliminate the chinstrap but are intended to prevent minor shifts during normal use and to reserve the chinstrap for events such as accidents. These systems rely on a retention system that applies pressure to selected points on the head. In the case of the bicycle helmets with the occipital cradle, what amounts to a triangular retention system is created. In this system pressure is applied to a set of points below the occipital bone, points above the occipital bone, and points approximately in the middle of the forehead. However, these systems still rely on a chinstrap for retention purposes. Therefore there is still a pressure point under the chin.

U.S. Pat. No. 5,806,535 to Becker describes a head band with upper and lower bands continuously interconnecting along an entire circumference of a head.

International Patent No. PCT/KR03/001691 to Kim describes a head band with upper and lower bands episodically continuously interconnecting along an entire circumference of a head.

U.S. Pat. No. 6,397,399 to Lampe et al. teaches padding enclosed in a fabric covering. The fabric covering stretches to conform the padding to the head.

U.S. Pat. Nos. 6,266,827 and 6,349,416 to Lampe et al. reveal fit and retention systems with adjustment straps located in positions other than those where chinstraps would typically be located. Unlike a baseball cap, these devices may have two or more dependent circular lines of retention created by ribs which are fastened together in an overlapping position to conform to a human head.

SUMMARY OF THE INVENTION

The present claimed invention is directed to a protective headguard, comprising a rear pad configured and arranged to protectively cover at least the occipital lobe on the back of a human head when the headguard is worn on the head. The rear pad has an inner major surface and a sagittally inset eccentric dimple in the inner major surface configured and arranged for accommodating the occipital lobe. A front pad is configured and arranged to protectively cover at least the forehead of a human when the headguard is worn on the head. The front pad is releasably interconnected to the rear pad at separate and distinct upper and lower connection points on the rear pad positioned on opposite sides of the dimple. The fit of the headguard can be adjusted between a first configuration and a second configuration by disconnecting the front and rear pads, rotating the rear pad 180° about a sagittally extending axis defined by the dimple, and reconnecting the front and rear pads with the front pad connections to the rear pad exchanged as between the upper and lower connection points.

DETAILED DESCRIPTION OF A PREFERRED EMBODIMENT

Figure 1:
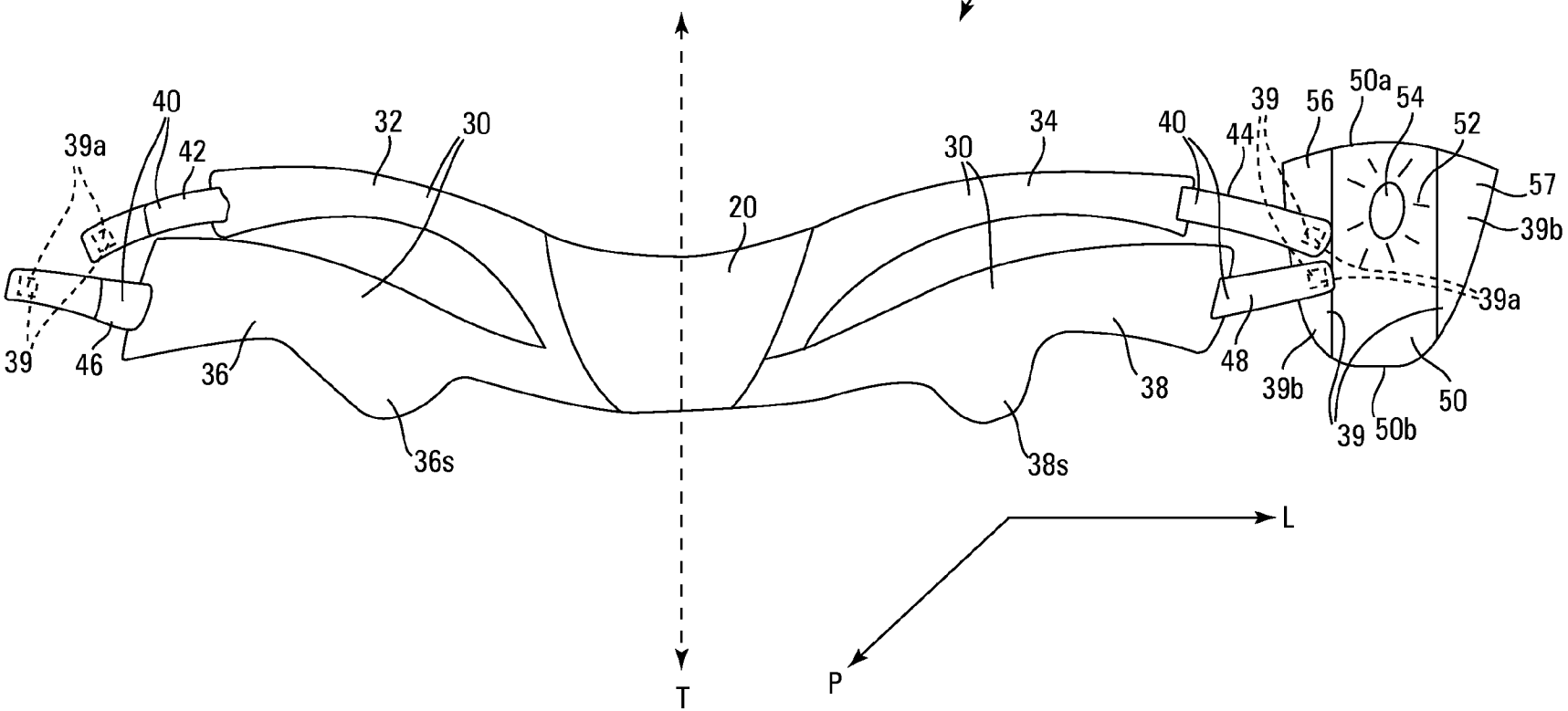
FIG. 1 is a front perspective view of one embodiment of the present invention.

| Nomenclature | |
|---|---|
| 10 | Headguard |
| 20 | Front Pad |
| 30 | Bands |
| 32 | Left Upper Band |
| 34 | Right Upper Band |
| 36 | Left Lower Band |
| 36s | Left Scallop |
| 38 | Right Lower Band |
| 38s | Right Scallop |
| 39 | Hook and Loop Tape |
| 39a | Hook Portion of Hook and Loop Tape |
| 39b | Loop Portion of Hook and Loop Tape |
| 40 | Adjustment Straps |
| 42 | Left Upper Adjustment Straps |
| 44 | Right Upper Adjustment Straps |
| 46 | Left Lower Adjustment Straps |
| 48 | Right Lower Adjustment Straps |
| 50 | Rear Pad |
| 50a | First Longitudinal End of Rear Pad |
| 50b | Second Longitudinal End of Rear Pad |
| 51 | Interior Surface of Rear Pad |
| 52 | Dimple |
| 53 | Exterior Surface |
| 54 | Channel |
| 56 | First Attachment Area |
| 57 | Second Attachment Area |
| 100 | Human Head |
| 102 | Forehead |
| 104 | Temple Area |
| 106 | Ear |
| 108 | Occipital Bone |
| T | Longitudinal Center Line |
| L | Lateral Line |
| P | Pad Thickness Line |

Construction

First Embodiment

The present claimed invention is intended to improve fit and retention of a headguard 10 around a human head 100. The headguard 10 can be used for many purposes. For example, uses could include soccer or other activities where a lightweight, well-ventilated, snug fitting, and securely affixed protective headguard 10 is desirable. As a user perspires a headguard will have a greater tendency to move out of its intended position.

The shape of the human head 100, above the eye brows, is basically a cone. The occipital bone 108 of the human head 100 is a curved, protruding bone located on the back part of the skull at the base of the cranium. The occipital bone 108 joins the parietal and temporal bones and protects the occipital lobe of the brain. When any flat object, such as a headband or headguard 10, is wrapped around the head 100 it has a tendency to "slip or slide" upward leaving portions of the occipital bone 108 unprotected. In order to protect the occipital bone 108 and help ensure the headband 10 fits flush and secure to the head 100, the rear pad 50 of the headguard 10 has a cup shape or an eccentric dimple 52 to accommodate the occipital bone 108.

Figure 2:
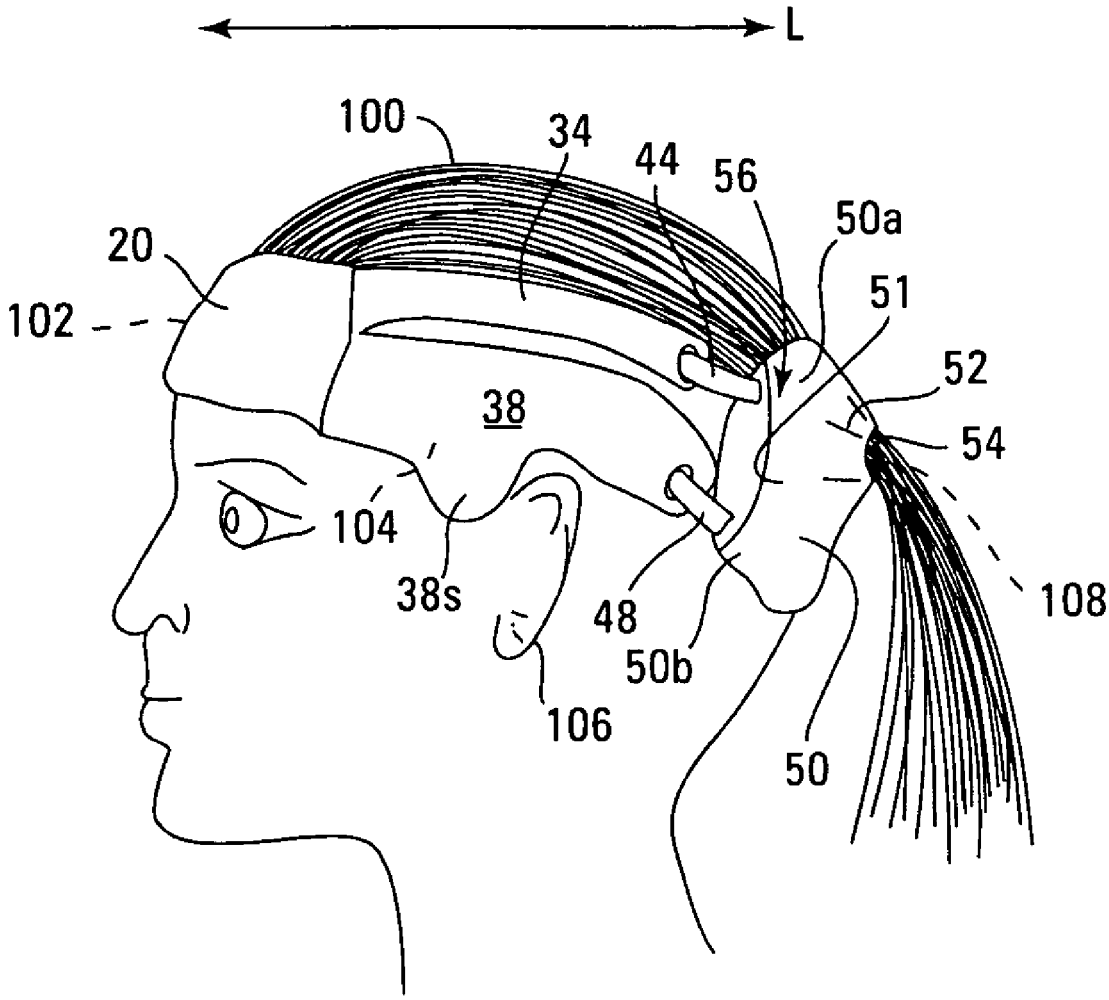
FIG. 2 is a side elevation view the invention of FIG. 1 worn on a human head in a first configuration.
Figure 3:
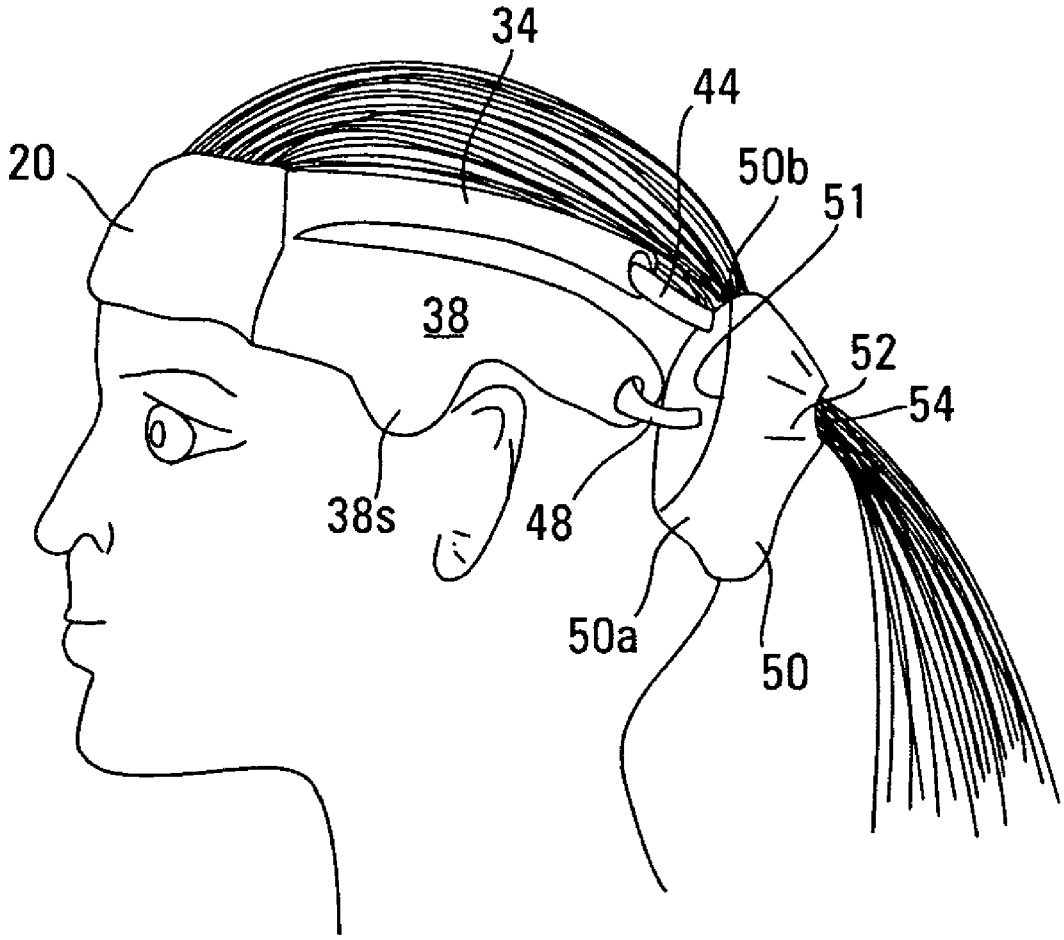
FIG. 3 is a side elevation view of the invention of FIG. 1 worn on a human head in a second configuration.

FIGS. 1-3 show one embodiment of a headguard 10 according to the present invention. The headguard 10 comprises a front pad 20, a rear pad 50, and left and right, upper and lower independently adjustable bands 32, 34, 36, 38 (collectively bands 30). As shown in FIG. 1, the front pad 20 can be oriented with a lateral line L and a longitudinal line T that is perpendicular to line L. The longitudinal line T bisects the front pad 20 into two equal halves. The front pad 20 can further be oriented along a line P denoting the thickness of the front pad 20. (The rear pad 50 can also be oriented in this fashion although this is not shown.).

The bands 30 extend laterally from the front pad 20 and wrap around the head 100. When measuring from the longitudinally extending center line T which bisects the front pad 20, the left and right upper bands 32 and 34 are a shorter lateral length that the left and right lower bands 36 and 38. The bands 30 are independently adjustable from each other. This allows a user to customize the length in order to secure the headband 10 comfortably upon the head 100. The left and right upper bands 32 and 34 will wrap around a human head 100 and connect to the rear pad 50 creating a first tensioned circumferential line of retention. The headguard 10 remains flush against the head along the first line of retention. A second tensioned circumferential line of retention is created when the lower, left and right bands 36 and 38 are secured flush around the head 100. Because the circumference of the first line of retention is smaller than the second line the headguard fits the natural conical shape of a human head 100 thus minimizing the amount of slippage which occurs while wearing the headguard 10.

The rear pad 50 has a cup shape or eccentric dimple 52 to better accommodate a user's occipital lobe 108 to allow the rear pad 50 to be secured and flush to the back of the head 100. The rear pad 50 has an inner major surface 51 and a sagittally inset eccentric dimple 52 on the inner major surface 51 configured and arranged for accommodating the occipital lobe 108.

As depicted in FIGS. 2 and 3, the rear pad 50 is connected to the front pad 20 by independent adjustment straps 42, 44, 46 and 48 (collectively straps 40). Separate and distinct first 56 and second 57 attachment areas are located on the rear pad 50 and are positioned on opposite sides of the dimple 52. The occipital bone 108 of each individual user is located in different positions on the head 100. A user may rotate the rear pad 180° around a sagittally extending axis defined by the dimple 52 to permit a user to select the most comfortable fit for the headband 10 based upon the position of the user's occipital lobe 108. The adjustment straps 40 are capable of attaching to either of the attachment areas 56 and 57. The two possible configurations in which the rear pad 50 can be secured to the head 100 are depicted in FIGS. 2 and 3.

As shown in FIG. 2, in a first configuration the rear pad 50 is positioned with first longitudinal end 50*a* up and the second longitudinal end 50*b* down, resulting in (i) attachment strap 42 attached to the second attachment area 57 proximate the first longitudinal end 50*a*, (ii) attachment strap 44 attached to the first attachment area 56 proximate the first longitudinal end 50*a*, (iii) attachment strap 46 attached to the second attachment area 57 proximate the second longitudinal end 50*b*, and (iv) attachment strap 48 attached to the first attachment area 56 proximate the second longitudinal end 50*b*.

As shown in FIG. 3, in a second configuration the rear pad 50 is positioned with the second longitudinal end 50*b* up and the first longitudinal end 50*a* down, resulting in (i) attachment strap 42 attached to the first attachment area 56 proximate the second longitudinal end 50*b*, (ii) attachment strap 44 attached to the second attachment area 57 proximate the second longitudinal end 50*b*, (iii) attachment strap 46 attached to the first attachment area 56 proximate the first longitudinal end 50*a*, and (iv) attachment strap 48 attached to the second attachment area 57 proximate the first longitudinal end 50*a*. In the second configuration the rear pad 50 is oriented with the dimple 52 positioned toward the lower part of the head 100 while still covering an area primarily on and around the occipital bone 108. The front pad 50 and the bands 30 remain in the same positional relationship, with a minor adjustment in the position of the front pad 50 and the bands 30 upon the head 100 due to the modest change in the point at which the straps 40 attach to the rear pad 50 relative to the occipital bone 108.

The rear pad 50 can also have a transversely extending channel 54 running through the rear pad 50 to allow a user's hair or pony tail to extend through the channel 54 when the headguard 10 is worn providing for a more comfortable and securely fitting headguard 10 around a head.

Scallops 36*s* and 38*s* extend longitudinally downward from the left and right bands 36 and 38 respectively to protectively cover at least a portion of the temple area 104 of a human head 100 without covering the ears 106. This allows the user to have protection to the critical temple area 104 while not sacrificing the ability to hear due to the headguard 10 covering the ear 106 muffling the surrounding sounds.

FIG. 2 shows the headguard 10 worn on a human head 100 in a first configuration or orientation. In this embodiment the headguard 10 can encircle the head 100. The front pad 20 can cover an area from the forehead 102 to the temples 104 on either side of the head 100 to a portion of the head 100 above the ears 106. The bands 30 extend laterally from the front pad 50. The rear pad 50 covers an area primarily on and around the occipital bone 108. In the first configuration the rear pad 50 is oriented with the dimple 52 positioned toward the upper part of the head 100 with the user's ponytail extending through the channel 54.

Adjustment straps 40 connect the bands 30 to the rear pad 50 on either side of the head 100. The adjustment straps 40 can be made from an elastic material or stretchable foam to add additional tension to aid in retention of the headguard 10. Hook and loop tape 39 or a buckle (not shown) is provided proximate the distal ends (unnumbered) of the straps 40 and proximate on the left and right sides (unnumbered) of the rear pad 50 for permitting selective attachment of the straps 40 to the first or second attachment areas 56 and 57. By adjusting the individual adjustment straps 40 all four left and right, upper and lower bands 30 can be independently adjusted to optimally fit the human head 100.

The front pad 20, rear pad 50, bands 30, and scallops 36*s* and 38*s* can be made of many different materials. Closed cell foams of various kinds can be preferred for many applications. However, other kinds of foam including open-cell foams can be suitable for some applications. In addition, other forms of padding could be suitable. These could include gel materials. These can often be encased and sealed in stretchable films. Similarly, air or gases could be sealed in pockets (not shown) to provide padding. Finally, fibrous materials can also be used as padding.

The front pad 20, rear pad 50, bands 30 and scallops 36*s* and 38*s* can also be encased in coverings. The coverings can be made of various kinds of materials such as fabric. For most applications, an elastic and highly breathable material would be most suitable. For example, a fabric such as Spandex® from Du Pont Company could be suitable for many applications. Many other fabrics such as CoolMax® from Invista could also be suitable. CoolMax® is a product that could aid in moisture management. Other materials such as mesh materials could be used alone or in combination with various fabrics.

FIG. 3 shows the headguard 10 worn on a human head 100 in a second configuration. In the second configuration the rear pad 50 is oriented with the dimple 52 positioned toward the lower part of the head 100 while still covering an area primarily on and around the occipital bone 108. The front pad 50 and the bands 32, 36 are on the same positions and depicted in the first embodiment in FIG. 1.

We claim:

1. A protective headguard, comprising;

(a) a rear pad configured and arranged to protectively cover at least the occipital lobe on the back of a human head when the headguard is worn on the head, the rear pad having a sagittally extending center axis extending through a center point, an inner major surface and a sagittally inset dimple in the inner major surface eccentrically positioned relative to the sagittally extending center axis of the rear pad, the dimple configured and arranged for accommodating the occipital lobe, (b) a front pad configured and arranged to protectively cover at least the forehead of a human when the headguard is worn on the head, the front pad releasably interconnected to the rear pad at separate and distinct upper and lower connection points on the rear pad positioned on opposite sides of the dimple, (c) whereby the fit of the headguard can be adjusted between a first configuration and a second configuration by disconnecting the front and rear pads, rotating the rear pad 180° about the sagittally extending center axis defined by the rear pad, and reconnecting the front and rear pads with the front pad connections to the rear pad exchanged as between the upper and lower connection points, and (d) a transversely extending channel through the dimple configured and arranged to accommodate passage of a ponytail through the channel when the headguard is worn on the head.

2. The headguard of claim 1 further comprising adjustment straps connecting the front pad and the rear pad.

* * * * *